US008229142B2

(12) United States Patent
Colaizzi et al.

(10) Patent No.: US 8,229,142 B2
(45) Date of Patent: Jul. 24, 2012

(54) DEVICES AND SYSTEMS INCLUDING TRANSDUCERS

(75) Inventors: Vincent M. Colaizzi, Pittsburgh, PA (US); James A. Hendrickson, Freedom, PA (US); David Pickrell, State College, PA (US); Jeremy Frank, Pine Grove Mills, PA (US); Jacob Loverich, State College, PA (US)

(73) Assignee: Mine Safety Appliances Company, Cranberry Township, PA (US)

( * ) Notice: Subject to any disclaimer, the term of this patent is extended or adjusted under 35 U.S.C. 154(b) by 1209 days.

(21) Appl. No.: 12/006,494

(22) Filed: Jan. 3, 2008

(65) Prior Publication Data

US 2008/0260187 A1 Oct. 23, 2008

Related U.S. Application Data

(60) Provisional application No. 60/925,110, filed on Apr. 18, 2007.

(51) Int. Cl.
*H04R 25/00* (2006.01)

(52) U.S. Cl. ..... 381/190; 381/150; 381/162; 381/152; 381/398; 381/191; 381/423; 381/396; 381/426

(58) Field of Classification Search ..... 381/150, 381/162, 152, 398, 190, 191, 423, 396, 426
See application file for complete search history.

(56) References Cited

U.S. PATENT DOCUMENTS

| | | | | |
|---|---|---|---|---|
| 3,736,632 | A | 6/1973 | Barrow | 29/25.35 |
| 4,047,060 | A | 9/1977 | Schafft | 310/322 |
| 4,163,917 | A | 8/1979 | Levine | 310/327 |
| 4,556,812 | A | 12/1985 | Kline et al. | 310/324 |
| 2003/0006862 | A1 | 1/2003 | Takeuchi et al. | 333/187 |
| 2009/0290732 | A1 * | 11/2009 | Berriman et al. | 381/182 |

FOREIGN PATENT DOCUMENTS

| | | |
|---|---|---|
| DE | 35 25 724 | 2/1986 |
| GB | 1 526 950 | 9/1975 |

* cited by examiner

*Primary Examiner* — Ha Tran T Nguyen
*Assistant Examiner* — Suberr Chi
(74) *Attorney, Agent, or Firm* — Henry F. Bartony, Jr.; James G. Uber

(57) ABSTRACT

A device includes a substrate and a transducer attached to the substrate, wherein the substrate includes a surface to which the transducer is attached and at least one edge member extending along at least a portion of the outside edge of the surface. The surface can be a generally planar surface. The edge member is stiffer than the surface. In several embodiments, the transducer is adapted to vibrate. The transducer can, for example, be selected from the group consisting of a piezoelectric transducer, an electrostrictive transducer and a magnetostrictive transducer. Preferably, the transducer is attached to the surface of the substrate by a metallic bonding agent and, more particularly, by welding.

25 Claims, 13 Drawing Sheets

DEVICES AND SYSTEMS INCLUDING TRANSDUCERS

RELATED APPLICATIONS

This application claims priority on U.S. Provisional Patent Application No. 60/925,110 filed Apr. 18, 2007, the entire disclosure of which is incorporated herein by reference.

BACKGROUND OF THE INVENTION

The present invention relates to devices and systems including transducers (for example, vibrating transducers such as piezoelectric transducers, electrostrictive transducers, magnetostrictive transducers, thermal expansion polymer transducers etc.) and, particularly, to sound-generating devices and systems including such transducers.

Typically, devices including piezoelectric, electrostrictive and/or other sound-generating transducers such as buzzers, speakers, alarms, etc. (sometimes referred to herein as acoustic devices), are designed to function at room temperature. These devices often fail to maintain similar performance at various temperatures, specifically high temperatures. Typical acoustic devices are commonly constructed by attaching a vibrating sound element (such as a piezoelectric unimorph or bimorph) to a host structure (for example, a housing, frame, or chassis, herein referred to collectively as a host or a housing). A horn or acoustic resonator, sometimes referred to as an acoustic amplifier, is often included as a component of the acoustic device.

Vibrating sound elements are typically constructed by affixing a vibrating transducer (for example, a piezoelectric transducer, an electrostrictive transducer or a magnetostrictive transducer) to a metal substrate using an adhesive, such as an epoxy bond. Because mechanical properties such as stiffness of the adhesives in current use change at various temperatures (particularly, at high temperatures), it is difficult to design an acoustic device including such and adhesively bonded vibrating transducer that achieves consistent dynamic characteristics over a range of temperatures.

These vibrating sound elements are typically mounted to a host structure using one of several standard configurations. As, for example, illustrated in FIG. 1A, a vibrating sound element 10, including a transducer 12 mounted on metallic substrate 14 via an epoxy adhesive 16, can be clamped by "knife edge" clamping elements 20 at its perimeter to mount vibrating sound element 10 within a housing 30. Alternatively, as illustrated in FIG. 1B, a housing element 10*a* can be bonded using an epoxy adhesive 20*a* at its outer perimeter to a or host structure 30*a*. The mounting technique, referred to as a boundary condition, and its interaction with the host structure, also commonly results in varying behavior (for example, varying resonance frequency) of a device as the temperature varies.

An acoustic amplifier enhances the coupling of the vibrating sound element to the medium (for example, air) in which it is operating. In the case of an acoustic alarm, for example, resonators or horns are used to amplify the sound pressure generated by a piezoelectric vibrating element. Because properties such as density of the medium and sound speed through the medium change with temperature, the resonance frequency of the acoustic amplifier also changes with temperature.

The properties of and the performance of each of the vibrating sound element, the boundary condition, and the acoustic amplifier are thus temperature dependent. However, the direction and magnitude of, for example, frequency shift with varying temperature can be different. For example, increasing temperature shifts the resonance frequency of the vibrating sound element downward, but shifts the resonance frequency of the acoustic amplifier upward. The complicated and significant temperature dependencies of the various elements of piezoelectric and other types of acoustic devices typically limit the specified operating temperature range of such devices (for example, from room temperature to 200° F. or less). Other devices including piezoelectric and other transducers, such as energy collection devices, suffer from similar limitations.

It is thus desirable to develop devices and systems including transducers, as well as methods of fabrication and use thereof, that reduce or eliminate one or more of the above-identified problems and/or other problems associated with currently available methods, devices and systems.

SUMMARY OF THE INVENTION

In one aspect the present invention provides a device including a substrate and a transducer attached to the substrate. The substrate includes a surface to which the transducer is attached and at least one edge member extending along at least a portion of the outside edge of the surface. The surface can be a generally planar surface. The edge member is stiffer than the surface. In several embodiments, the transducer is adapted to vibrate. The transducer can, for example, be selected from the group consisting of a piezoelectric transducer, an electrostrictive transducer and a magnetostrictive transducer.

In a number of embodiments, the edge member extends in at least one direction outside of the plane of the surface. For example, the edge member can form a sidewall. The sidewall can, for example, extend around a portion of or around the full length of the outside edge of the surface.

The surface and the edge member of the substrate can be formed from a monolithic piece of material. The material can, for example, be a metal.

In several embodiments, the mass associated with the edge member results in a ratio of mass associated with the edge member to mass of the surface of at least 1.5 to 1. The ratio of the mass associated with the edge member to mass of the surface can also be at least 2 to 1, at least 3 to 1 or at least 4 to 1. A mass element can, for example, be positioned adjacent to the edge member to enhance vibration of the surface.

The transducer can be attached to the surface of the substrate such that the resonance frequency of the surface and attached transducer changes less than 25% from 70° F. to 250° F., changes less than 10% from 70° F. to 300° F. or even changes less than 5% from 70° F. to 500° F.

The transducer can, for example, be attached to the surface of the substrate such that the device, when excited at the resonance frequency of the surface and attached transducer, and after removal from an oven wherein the surface and attached transducer were heated to approximately 500° F. for at least five minutes, provides a sound level that does not diverge from the room temperature sound level by more than 10 dBA or provides an output of at least 95 dBA at a distance of 3 meters in an anechoic chamber, wherein sound level is measured in peak sound pressure level. In several embodiments, sound the level does not diverge from the room temperature sound level by more than 10 dBA and provides an output of at least 95 dBA at a distance of 3 meters in an anechoic chamber in devices of the present invention while maintaining the same electrical drive voltage at both room temperature and at elevated temperature.

The transducer of the devices of the present invention can, for example, be attached to the surface of the substrate by a metallic bonding agent between the transducer and the surface. In several embodiments, the transducer is attached to the surface of the substrate by welding, brazing, soldering, or other metal adhesion process. The transducer can also be attached to the surface of the substrate via diffusion bonding or via reaction bonding. A combination of attachment techniques and/or conditions can be used.

The device can further include a suspension in operative connection with the substrate and extending outwardly from the substrate. The suspension can, for example, be formed from a flexible material. The suspension can be attached to the substrate to form a seal around the sidewall thereof.

The device can further include an acoustic amplifier. The acoustic resonance frequency of the acoustic amplifier can be lower than the mechanical resonance frequency of the transducer at a temperature of 70° F. The acoustic resonance frequency of the acoustic amplifier can also be higher than the mechanical resonance frequency of the transducer at a temperature of 500° F.

In another aspect, the present invention provides a device comprising a substrate and a transducer attached to the substrate, wherein the transducer is attached to the surface of the substrate such that the resonance frequency of the surface and attached transducer changes less than 25% from 70° F. to 250° F. The resonance frequency of the surface and the attached transducer can also changes less than 10% from 70° F. to 300° F. Still further, the resonance frequency of the surface and the attached transducer can change less than 5% from 70° F. to 500° F.

As described above, the transducer can be attached to the surface of the substrate by a metallic bonding agent between the transducer and the surface. For example, the transducer can be attached to the surface of the substrate by welding, brazing, soldering, or other metal adhesion process. Likewise, the transducer can be attached to the surface of the substrate via diffusion bonding or reaction bonding. Once again, combinations of attachment methods and conditions can be used.

The device can further include an acoustic amplifier, wherein the acoustic resonance frequency of the acoustic amplifier is lower than the mechanical resonance frequency of the transducer at a temperature of 70° F. The acoustic resonance frequency of the acoustic amplifier can also be higher than the mechanical resonance frequency of the transducer at a temperature of 500° F.

Various types of transducers can be used. In several embodiments, the transducer is selected from the group consisting of a piezoelectric transducer, an electrostrictive transducer and a magnetostrictive transducer.

In a further aspect, the present invention provides a device including a substrate and a transducer attached to the substrate. The transducer is attached to the surface of the substrate such that the device, when excited at the resonance frequency of the surface and attached transducer, and after removal from an oven wherein the surface and attached transducer were heated to approximately 500° F. for at least five minutes, provides a sound level that does not diverge from the room temperature sound level by more than 10 dBA or provides an output of at least 95 dBA at a distance of 3 meters in an anechoic chamber, wherein sound level is measured in peak sound pressure level.

In still a further aspect, the present invention provides a device including a substrate and a transducer attached to the substrate. The substrate includes a surface to which the transducer is attached and at least one edge member extending along at least a portion of the outside edge of the surface. The edge member is stiffer than the surface. The device further includes a suspension in operative connection with the edge member and extending outwardly from the substrate. The suspension can, for example, be formed from a flexible material. The edge member can, for example, be a sidewall extending around the outer edge of the surface. The suspension can be attached to the substrate to form a seal around the sidewall thereof. As described above, the transducer can, for example, be selected from the group consisting of a piezoelectric transducer, an electrostrictive transducer and a magnetostrictive transducer.

The present invention provides systems including devices as described above. For example, such devices can be used in a personal alert safety system and in other systems. The present invention also provides methods of making and using such devices and systems as described herein.

The present invention, along with the attributes and attendant advantages thereof, will best be appreciated and understood in view of the following detailed description taken in conjunction with the accompanying drawings.

DETAILED DESCRIPTION OF THE INVENTION

As used herein and in the appended claims, the singular forms "a," "an", and "the" include plural references unless the content clearly dictates otherwise. Thus, for example, reference to "a transducer" includes a plurality of such transducers and equivalents thereof known to those skilled in the art, and so forth, and reference to "the transducer" is a reference to one another more such transducers and equivalents thereof known to those skilled in the art, and so forth. All publications, patent applications, patents, and other references mentioned herein are incorporated by reference in their entirety.

Figure 2A:
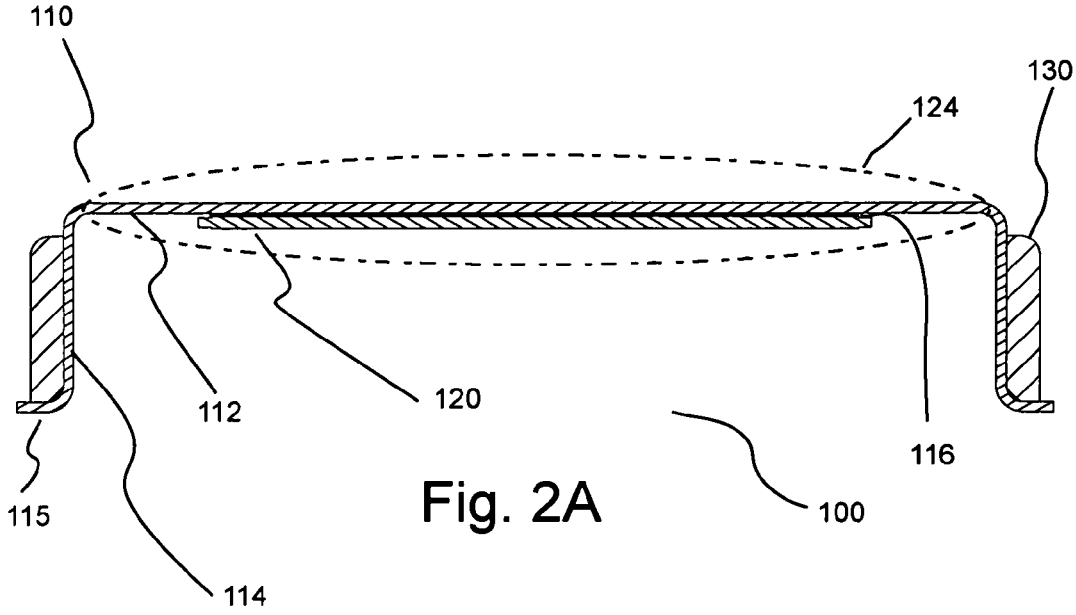
FIG. 2A illustrates an embodiment of a vibrating system of the present invention including a transducer such as a piezoelectric or other transducer.
Figure 2B:
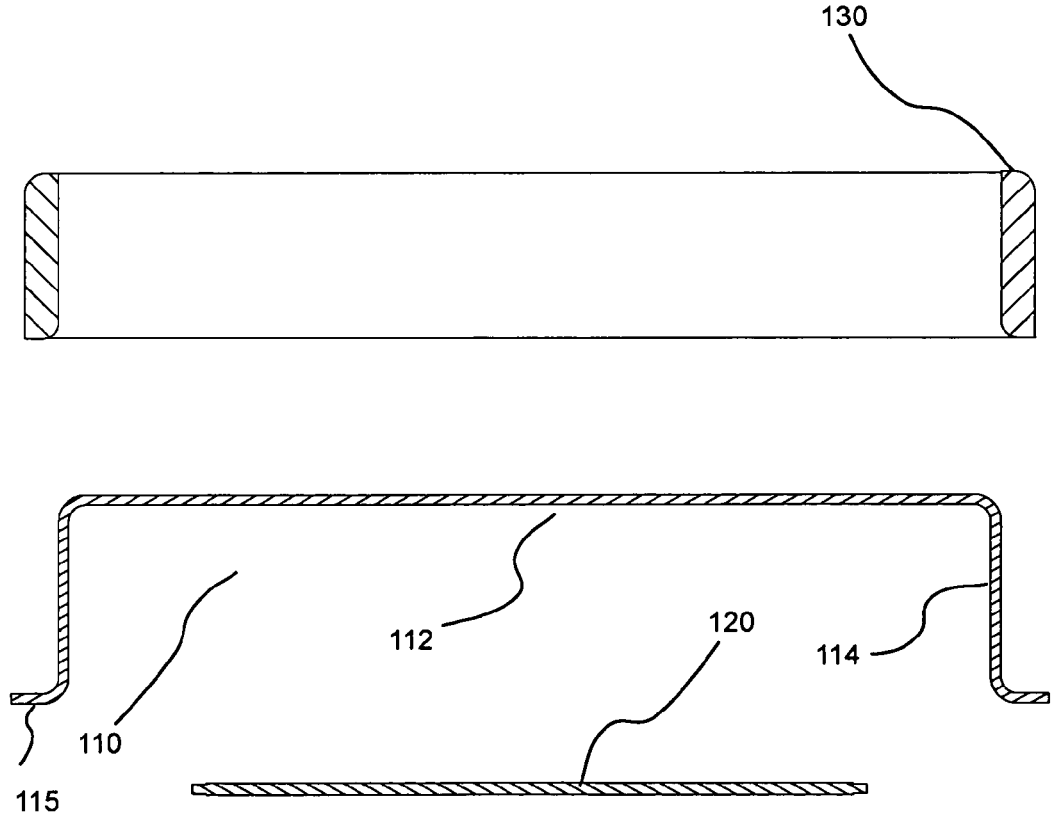
FIG. 2B illustrates an exploded view of the vibrating system of FIG. 1A.
Figure 3A:
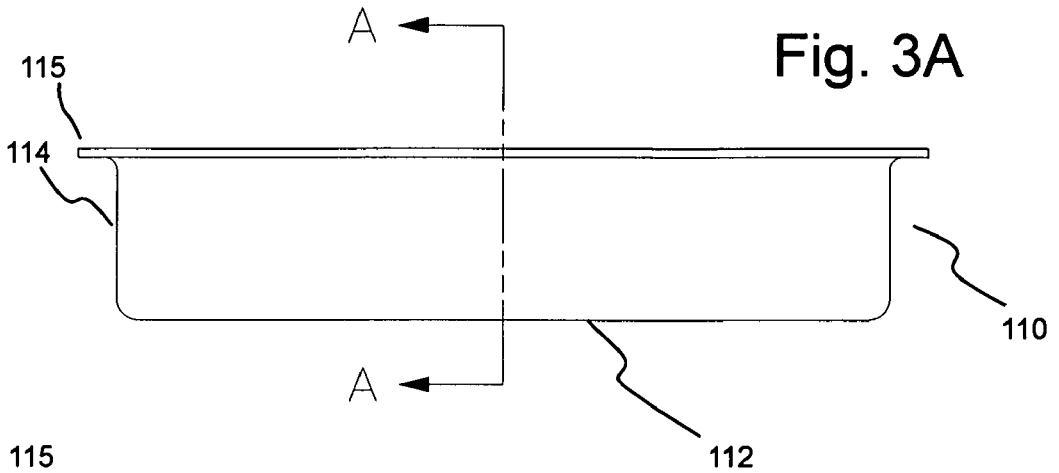
FIG. 3A illustrates a side view of the substrate of the vibrating system of FIG. 2A.
Figure 3B:
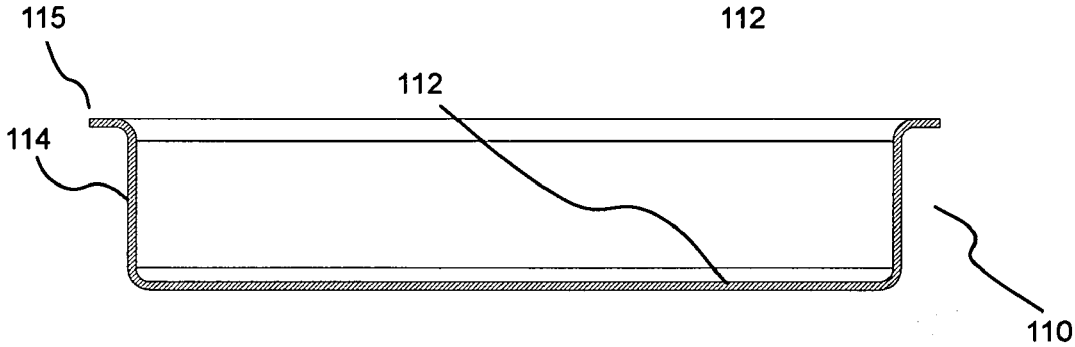
FIG. 3B illustrates a cross-sectional view of the substrate of FIG. 3A along section A-A.
Figure 3C:
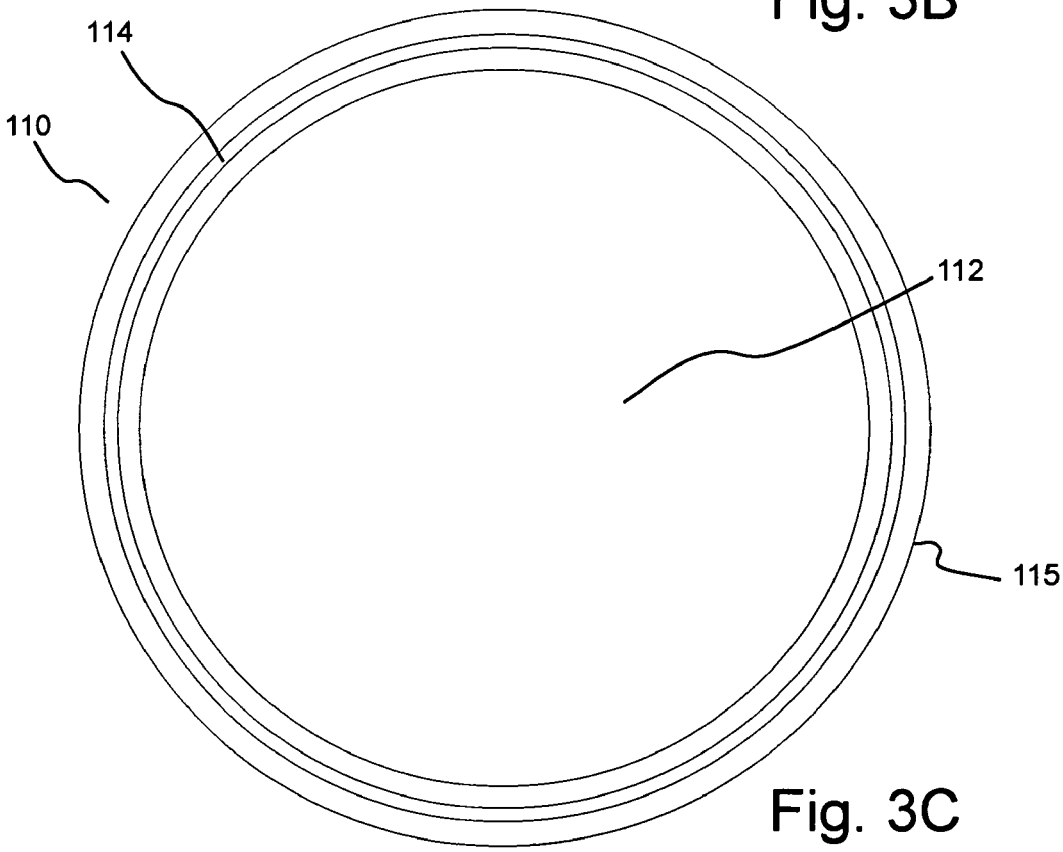
FIG. 3C illustrates a top plan view of the substrate of FIG. 3A.

FIGS. 2A and 2B illustrate an embodiment of a system 100 including a substrate 110 to which a transducer 120 that can be vibrated at a resonant frequency (for example, a piezoelectric transducer, an electrostrictive transducer, a magnetostrictive transducer etc.) is attached. Piezoelectric transducers, which are often used in sound generating systems, have permanent dipoles and the material can, therefore, be poled and left with a remnant polarization. Electrostrictive transducer are not permanently poled but can contract and expand in the manner of a piezoelectric transducer by application of an electric field thereto. Like piezoelectric transducers, electrostrictive transducers can be formed from ceramic materials. Magnetostrictive materials can convert magnetic energy into kinetic energy, or the reverse.

In several embodiments, substrate 110 was formed monolithically from a metallic material such as brass. In the illustrated embodiment, substrate 110 is formed in the general shape of a cup, including a generally planar surface 112 to which transducer 120 is attached and a generally cylindrical sidewall 114.

Figure 1A:
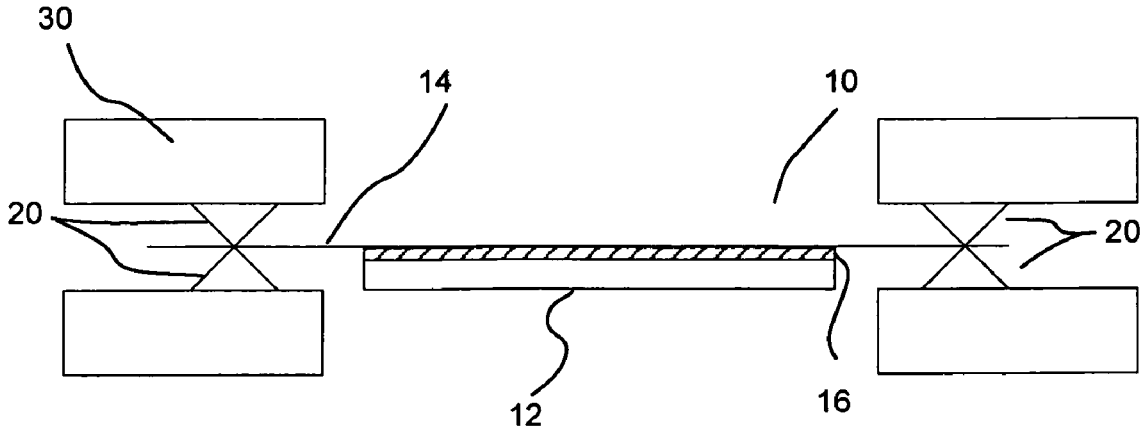
Fig. 1A PRIOR ART
FIG. 1A illustrates an embodiment of a current method for attaching a transducer to a surface that can be caused to vibrate.
Figure 1B:
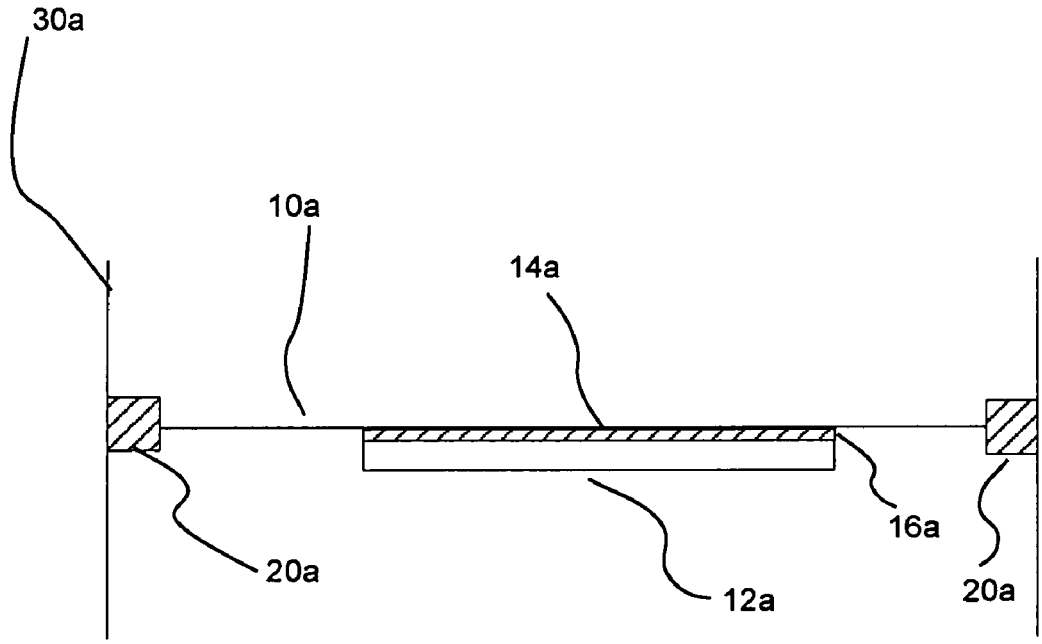
Fig. 1B PRIOR ART
FIG. 1B illustrates another embodiment of a current method for attaching a transducer to a surface that can be caused to vibrate.

In several embodiments, transducer 120 is attached to surface 112 of substrate 110 via an attachment having generally constant mechanical properties over a broad temperature range. In that regard, transducer 120 is attached to the surface of substrate 110 such that the resonance frequency of the surface and attached transducer changes less than 25% over a temperature range of at least approximately 70° F. to 250° F., 70° F. to 300° F. or even −30° F. to 500° F. Currently available sound generating elements as, for example, described in connection with FIGS. 1A and 1B, exhibit a significant frequency shift of, for example, as much as 25% over such temperature ranges. In that regard, unlike currently available sound generating systems including, for example, piezoelectric transducers (and without limitation to any mechanism), it is believed that the attachment between substrate surface 112 and transducer 120 in the present invention does not change (for example, soften) with increasing temperature such that the vibratory characteristics (for example, frequency) of the system do not change substantially with varying temperature.

There are many methods for joining or attaching ceramics to metals and numerous variations on such methods that are suitable for use in the present invention. The attaching methods can, for example, be broadly divided based upon what forms the bond between the surfaces or upon how the energy is applied to achieve the bond. In terms of formation of the bond, one way to bond a metal to ceramic is using a metallic bonding agent such as a weld, solder braze in the manner in which one would join two metals. In the use of methods such as soldering and brazing, a thin metal coating is typically pre-applied to the ceramic surface before soldering or brazing. The thin metallic coating can, for example, be applied using techniques such as chemical plating, sputtering, evaporation or by screen printing and firing. Soldering and brazing techniques use metal powders or pastes that melt at high temperatures forming a pool of liquid metal which subsequently solidifies to bond the metal to the ceramic.

A molten glass can also be used to join a metal to ceramic. Use of a molten glass typically requires pre-coating of the metal so that the glass will wet and bond to it. Use of a molten glass bonding agent is analogous to, for example, a metal welding, soldering or brazing process except that the molten bonding agent is an oxide material rather than a metal.

Diffusion bonding typically involves joining a ceramic and a metal without a bonding material between the metal and ceramic. In diffusion bonding, the metal and the ceramic are polished to a very smooth surface, forced together (usually under relatively high pressure), and then heated until the atoms from each material interdiffuse between one another to form a bond.

In reaction bonding, a material is typically placed between the ceramic and the metal to be joined that chemically reacts with the two materials to form a bond. The bonding can occur in a solid state or there can be melting which occurs and promotes the reaction. The bond material typically contains components that react exothermically (that is, releasing heat). The reaction becomes self-propagating once initiated as a result of the heat generated by the reactants in the bond material.

Energy can be applied to achieve a bond between a ceramic and a metal in various ways. For example, one can use resistance heat in a furnace. Other ways to apply energy include microwave heating, radio frequency (rf) induction heating, ultrasonic welding, contact flames (such as is applied using an acetylene torch), laser welding, etc. Since one skilled in the art can combine different bond types and heating techniques, a multitude of specific bonding methods can be utilized. In one example of a hybrid process, a reaction bond material (after initiation with, for example, a spark) reacts exothermically to heat and melt solder layers that were pre-applied to the ceramic and metal surface. In this process, the reaction bond material is positioned between the solder on the ceramic and on the metal. The reaction bond material does not react with the ceramic and metal surface but simply provides heat for the melting of the solder, which effects the actual bonding process.

In certain embodiments, a high temperature resistant adhesive (for example, an epoxy adhesive) can also be used in the devices and systems of the present invention. A number of epoxies suitable for use in certain embodiments of the present invention are described in Table 1 below. Use of epoxy adhesive can, in certain circumstances, result in a more limited temperature range of operation than other attachment techniques as described above. A suitable attachment technique for a given use can readily be determined by one skilled in the art in light of the disclosure of the present specification and the knowledge in the art.

TABLE 1

| Manufacturer | Model | Indicated Operating Temp | Hardness |
|---|---|---|---|
| VonRoll Isola | E-SOLDER 3021 | 150° C. | Shore D-70 |
| Epoxies Etc . . . | 40-3900 | −50° C. to 170° C. | Shore D-70 |
| Epoxies Etc . . . | 40-3905 | −50° C. to 165° C. | Shore D-85 |
| Epoxies Etc . . . | 40-3910 | −55° C. to 170° C. | N/A |
| Mereco | METREGRIP 303VLV | −65° C. to 145° C. | N/A |
| Tra-Con | TRA-BOND F123LV | −60° C. to 175° C. | Shore D-87 |
| Tra-Con | TRA-BOND F123 | −60° C. to 175° C. | Shore D-87 |
| Tra-Con | TRA-BOND F123HV | −60° C. to 175° C. | Shore D-87 |
| Epoxy Technology | EPO-TEK 301-2 | −55° C. to 200° C. | Shore D-80 |
| Epoxies Etc . . . | 50-3186 | −40° C. to 230° C. | Shore D-90 |
| Emerson & Cuming | ECCOBOND 104 A/B | −25° C. to 230° C. | Shore D-90 |
| Tra-Con | TRA-BOND F202 | −60° C. to 265° C. | Shore D-87 |

In several preferred embodiments of the present invention, transducer 120 can, for example, be attached to surface 112 of substrate 110 by a metallic bonding agent 116 (see FIG. 2A) as described above. Transducer 120 can, for example, be attached to surface 112 of substrate 110, for example, by welding, brazing, soldering, or another metal adhesion process. Likewise, another metal-ceramic bonding technique as described above or combinations thereof can be used. For example, transducer 120 can also be attached to surface 112 via diffusion bonding, reaction bonding or combinations thereof. The bonding techniques described above provide for an attachment of transducer 120 to surface 112 that does not vary significantly in mechanical properties (for example, in stiffness) over a wide temperature range, particularly at high temperature, as compared to adhesive bonds used in currently available sound generating or other devices including, for example, piezoelectric transducers. In that regard, the bonding technique results in an attachment such that the resonance frequency of the surface and attached transducer does not change significantly over a broad temperature range as described above.

In several representative embodiments of the present invention, a ceramic PZT-5A piezoelectric transducer, which was pre-metallized with a thin silver metal coating on both sides by a thick film screen printing and firing process, was attached to surface 112 of a brass substrate 110 by soldering. Transducer 120 was attached to substrate 110 after an elastomeric suspension described below (for example, support member 140 in connection with FIGS. 5A through 5C) was overmolded on substrate 110. In the transducer attachment process, surface 112 of brass substrate 110 was first cleaned with a wire brush and then in an ultrasonic cleaner. After drying substrate 110, the soldering material was placed on ceramic transducer 120 in a screen printing process. Transducer 120 was placed into the screen printer and the vacuum pump was activated. Solder was placed on a squeegee, and transducer 120 was screen printed. After turning off the vacuum and removing transducer 120, transducer 120 was centered on surface 112 with the solder in contact with surface 112. Surface 112 was then "pre-heated" via contact with a hot plate element (at a temperature of approximately 250° C.) for about one minute. The assembly was then moved from the "pre-heat" hot plate to a "re-flow" hot plate (at a temperature of approximately 350° C., which is above the melting point of the soldering material—approximately 275° C.). The assembly was observed to determine when solder began to flow. Upon observing solder flow, the assembly was removed from the hot plate. The assembly was typically removed from contact with the re-flow hot plate element after about 10-20 seconds.

Exposure of a transducer to elevated temperatures can result in damage to the transducer. For example, It is known that exposure of a piezoelectric transducer to high temperatures can result in a piezoelectric transducer that is depoled. However, exposure of the piezoelectric transducers of the present invention to transient high temperatures during the metal bonding processes such as soldering did not adversely affect the operation thereof.

After attachment of transducer 120 to substrate 110 as described above, the assembled parts were place in an ultrasonic cleaner for about 30 seconds to clean the assembly.

In the illustrated embodiment of, for example, FIGS. 2A through 3C, a nodal line (generally, defining surface 112) is created in substrate 110 by bending the metal of substrate 110 to create an edge member in the form of sidewall 114. The bend creates an area that is stiffer (that is, more resistant to flexing and, therefore, less susceptible to vibration) than surface 112. The term "nodal line" refers generally to the line separating that portion of substrate 110 (generally, surface 112) that vibrates from the remainder of substrate 110 that does not vibrate, or vibrates out of phase. Sidewall 114 and other edge members of the present invention also provide a reaction mass that achieves a desired (or enhanced) vibration behavior of surface 112 and attached transducer 120 (forming vibrating sound element 124), while enabling improved techniques for supporting or holding system 100 within, for example, a housing 160 to isolate system 100 from such a housing. The interaction of system 100 with housing 160 is described further below in connection with an embodiment of a PASS alarm of the present invention illustrated in FIGS. 9A through 9G.

As illustrated in, for example, FIGS. 2A and 2B, a mass element 130 can be placed in association with sidewall 114 to further define the nodal line and improve vibratory characteristics of vibratory sound element 124. In several embodiments, mass element 130 was formed from a metal (for example, brass) as a cylindrical member having a inner radius slightly greater than the outer radius of sidewall 114.

In several embodiments of the present invention, the ratio of the reaction mass associated with an edge member such as sidewall 114 to the mass of the surface to which the transducer is attached is at least 1.5 to 1. The ratio can also be at least 2 to 1, at least 3 to 1 or at least 4 to 1.

Figure 4A:
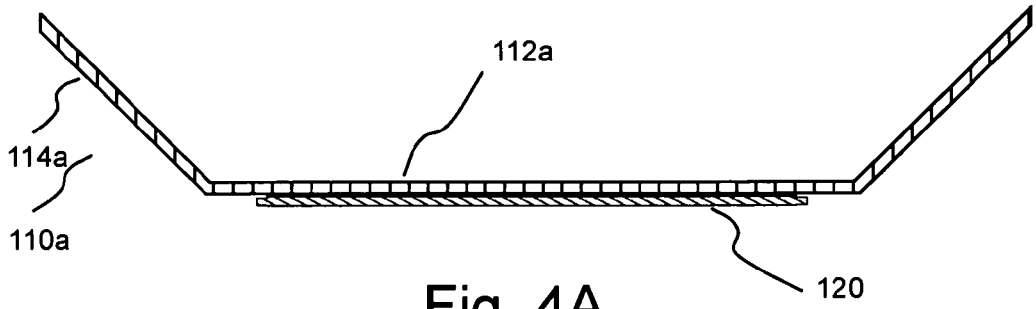
FIG. 4A illustrates a cross-sectional view of another embodiment of a substrate of the present invention including a sidewall that extends out of the plane of the generally planar surface of the substrate.
Figure 4B:
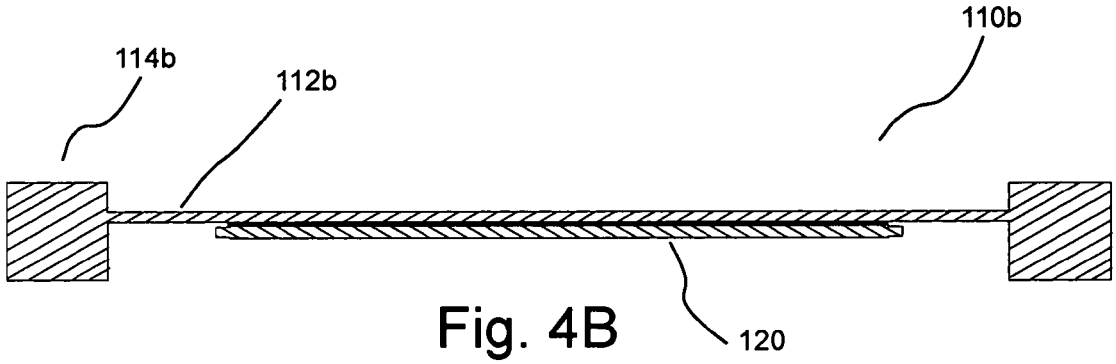
FIG. 4B illustrates a cross-sectional view of another embodiment of a substrate of the present invention.
Figure 4C:
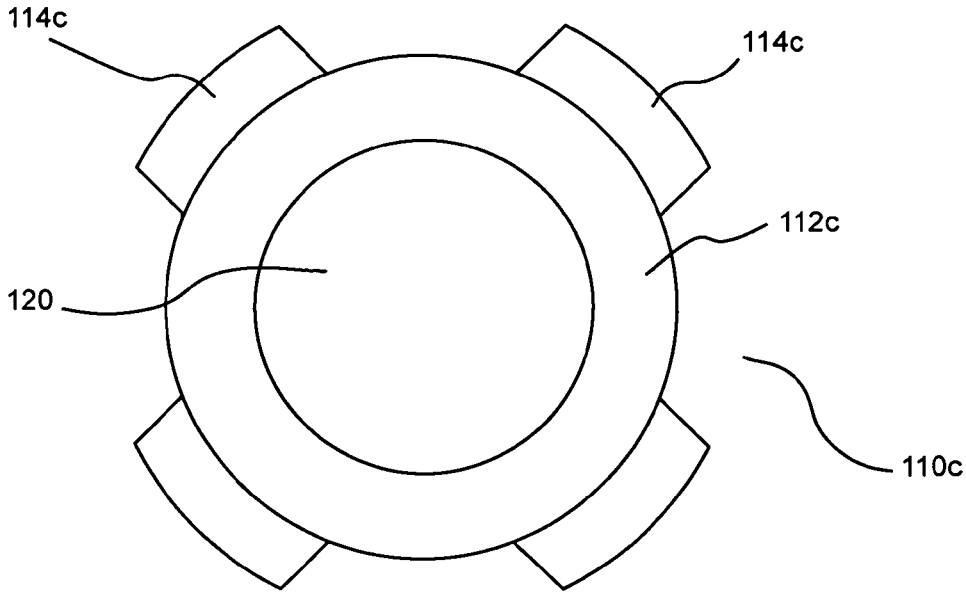
FIG. 4C illustrates a bottom view of another embodiment of a substrate of the present invention including a plurality of edge members that extend along a portion of the surface of the substrate.

As illustrated, for example, in FIGS. 4A through 4C, edge members of the present invention can take various forms. In the embodiment of FIGS. 2A through 3C discussed above, sidewall 114 extends generally perpendicular to the plane of surface 112. In the embodiment of FIG. 4A, sidewall 114*a* of substrate 110*a* extends at an obtuse angle from surface 112*a*. Substrates of the present invention can be formed with a sidewall extending from the surface to which the transducer is attached at generally any angle out of the plane of the surface to create a nodal line as described above. Moreover, such a sidewall can also extend from the surface in the form of an arc or radius.

In the embodiment of FIG. 4B, substrate 110*b* includes a generally planar surface 112*b* and an edge member 114*b* extending along the edge thereof having a thickness and stiffness greater than surface 112*b*. Substrate 110*b* can, for example, be formed from a monolithic piece of a metal by, for example, machining the metal to the shape illustrated FIG. 4B.

As illustrated in FIG. 4C one or more edge members 114*c* of a substrate 110*c* of the present invention can extend along only a portion of the outer edge or the perimeter of a surface 112*c* of substrate 110.

Figure 4D:
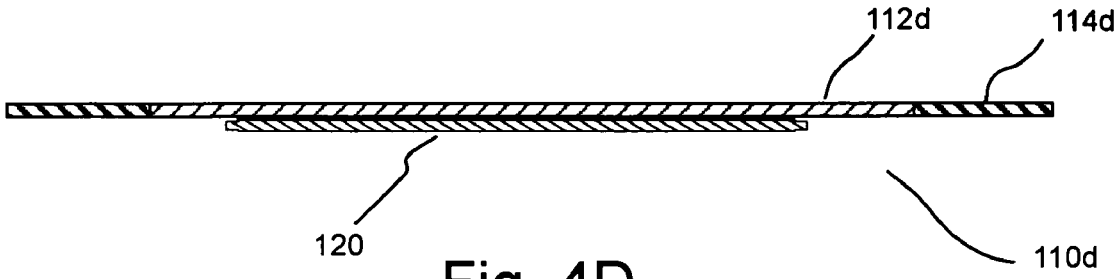
FIG. 4D illustrates a side, cross-sectional view of an embodiment of a substrate of the present invention having a transducer attached thereto and including an edge member extending outwardly from an outer edge thereof.
Figure 4E:
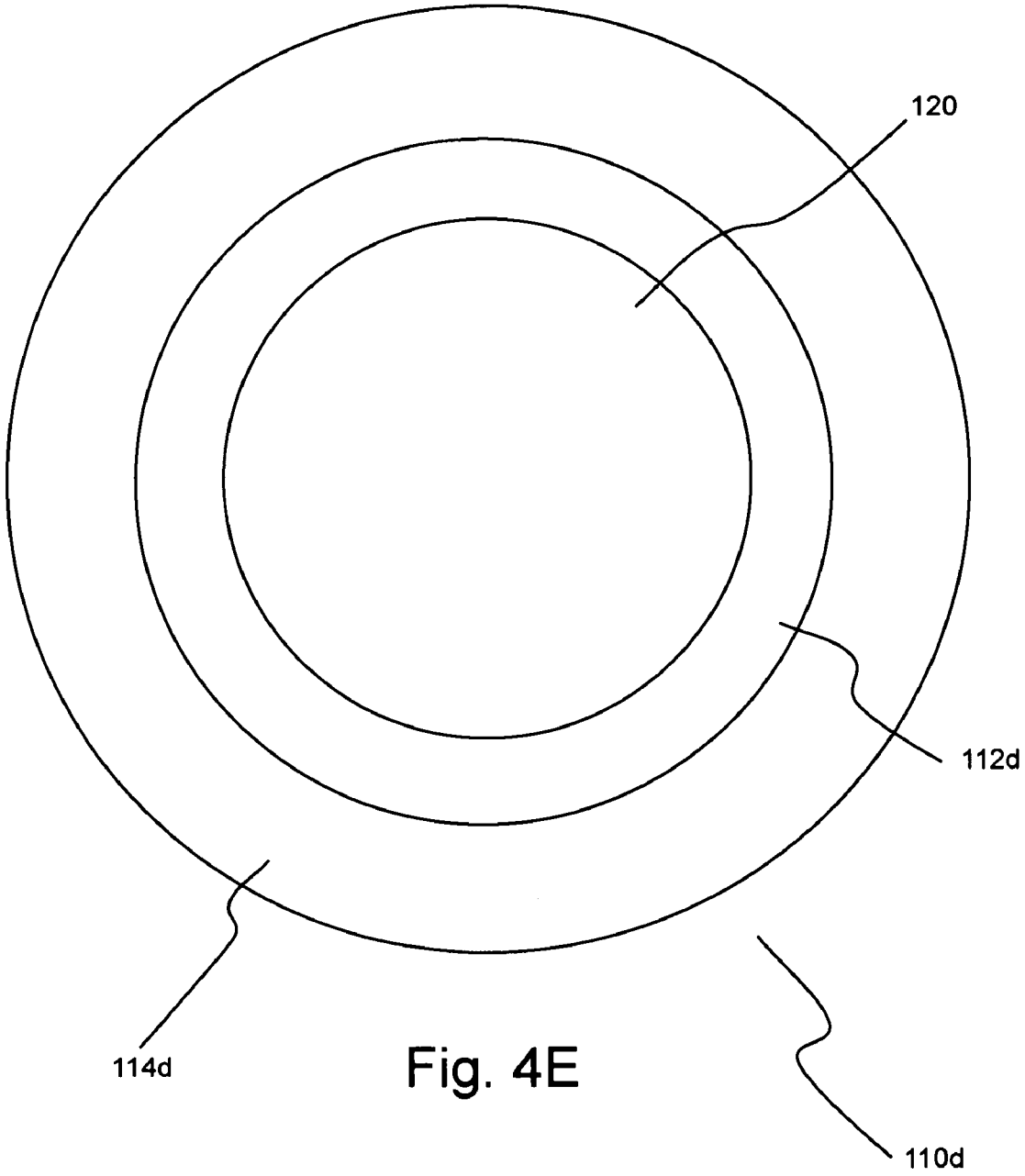
FIG. 4E illustrates a bottom view of the substrate assembly of FIG. 4D.

As described above in connection with several embodiments of the present invention, edge members of the present invention can be formed monolithically with the remainder of the substrate. Alternatively, an edge member can be attached to a surface (for example, using a metal bonding technique or other technique that is stable over a relatively broad temperature range as described above) to from a substrate of the present invention. As illustrated in FIGS. 4D and 4E, an annular edge member 114*d* can be attached (for example, by welding in the case of two metals) to a generally circular surface 112*d* to from substrate 110*d*. As also illustrated in FIGS. 4D and 4E, edge member 114*d* need not extend in a direction out of the plane of surface 112*d*. The material of edge member 114*d* can, for example, be stiffer than the material of surface 112*d*.

Moreover, although the substrate surfaces to which transducer 120 is attached have been illustrated in various representative examples herein to be generally circular, one skilled in the art appreciates that such surfaces can vary widely in geometry (for example, oval, square, triangular etc.).

Figure 5A:
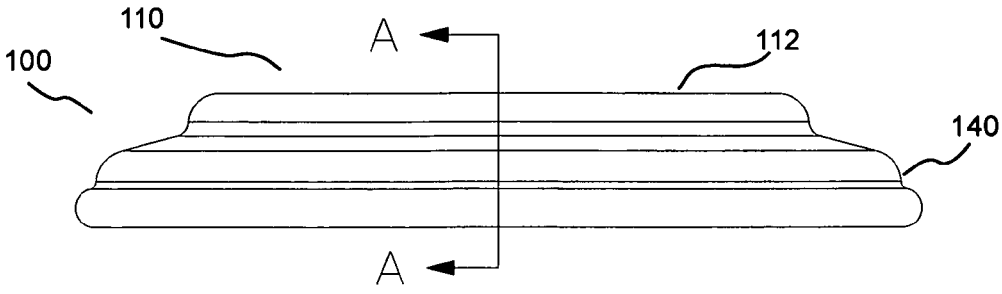
FIG. 5A illustrates a side view of the substrate of the vibrating system of FIG. 2A wherein a flexible suspension has been attached thereto.
Figure 5B:
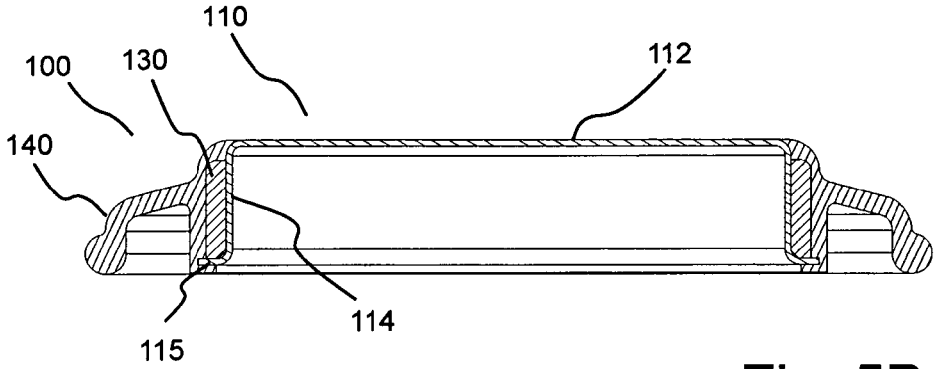
FIG. 5B illustrates a cross-sectional view of the system of FIG. 5A along section A-A before attachment of the piezoelectric transducer thereto.
Figure 5C:
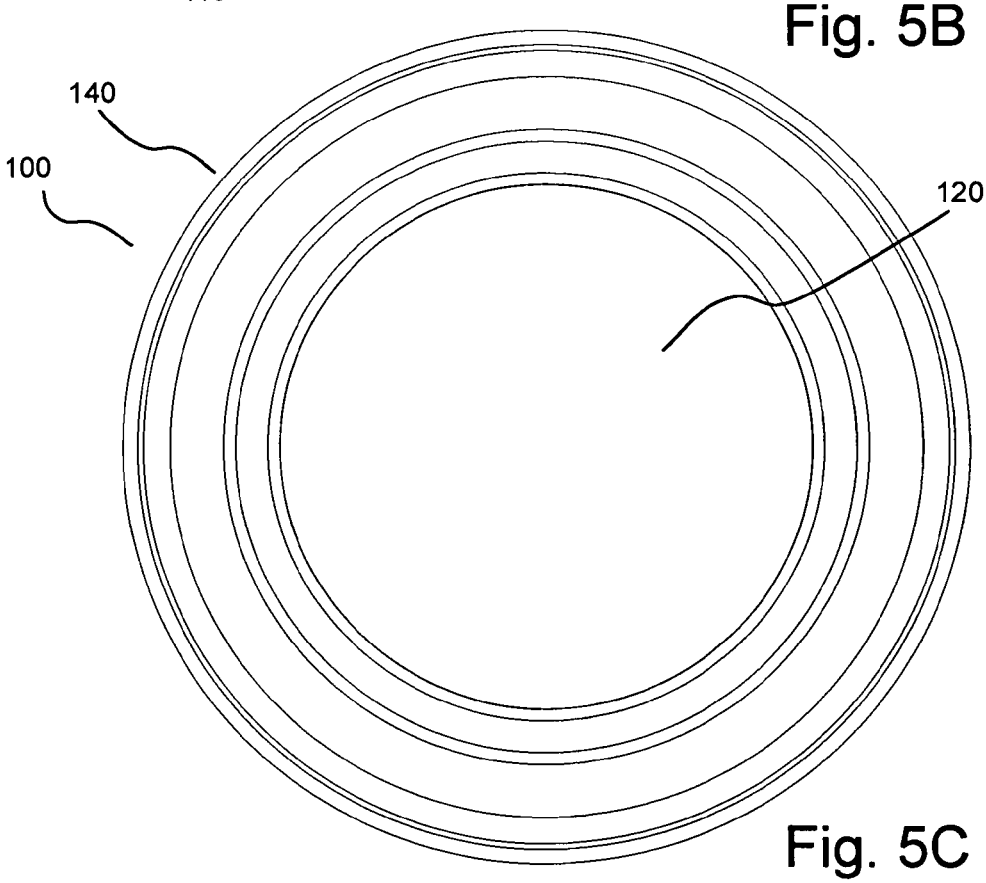
FIG. 5C illustrates a top plan view of the system of FIG. 5A.

As described above, in addition to creating a nodal line and providing a reaction mass to enhance vibration, edge members of the present invention also enable improved techniques for supporting or holding the systems of the present invention within, for example, a housing. In that regard, FIGS. 5A-5C illustrate an embodiment of system 100 of the present invention further including a flexible support member 140 for supporting or holding system 100 within housing 160 (see, for example, FIG. 9A). Support member 140 extends outwardly from substrate 110 and supports system 100 and vibrating sound element 124 thereof in suspension so that the holding technique does not adversely affect the vibration of vibrating sound element 124. For example, system 100 can be supported by a low-stiffness suspension using a soft, elastomeric (for example, rubber) ring as flexible support member 140 installed into housing 160. In several embodiments, support member 140 was overmolded upon an assembly of substrate 110 and mass element 130. The overmolding process captured mass element 130 between support member 140 and substrate 110. In the illustrated embodiment, sidewall 114 of substrate 110 included a lower flange portion 115 to assist in seating and capturing mass element 130.

In applications requiring a seal between vibrating sound element 124 and a housing such as housing 160, flexible support member 140 also provides an adequate seal from, for example, moisture in the surrounding environment. Further, flexible support member 140 mechanically isolates vibrating sound element 124 from severe vibration or shock conditions experienced by housing 160. Alternatively, vibrating sound element 124 can be held at or outside of its vibration nodal line, typically at the location of mass element 130.

Figure 6A:
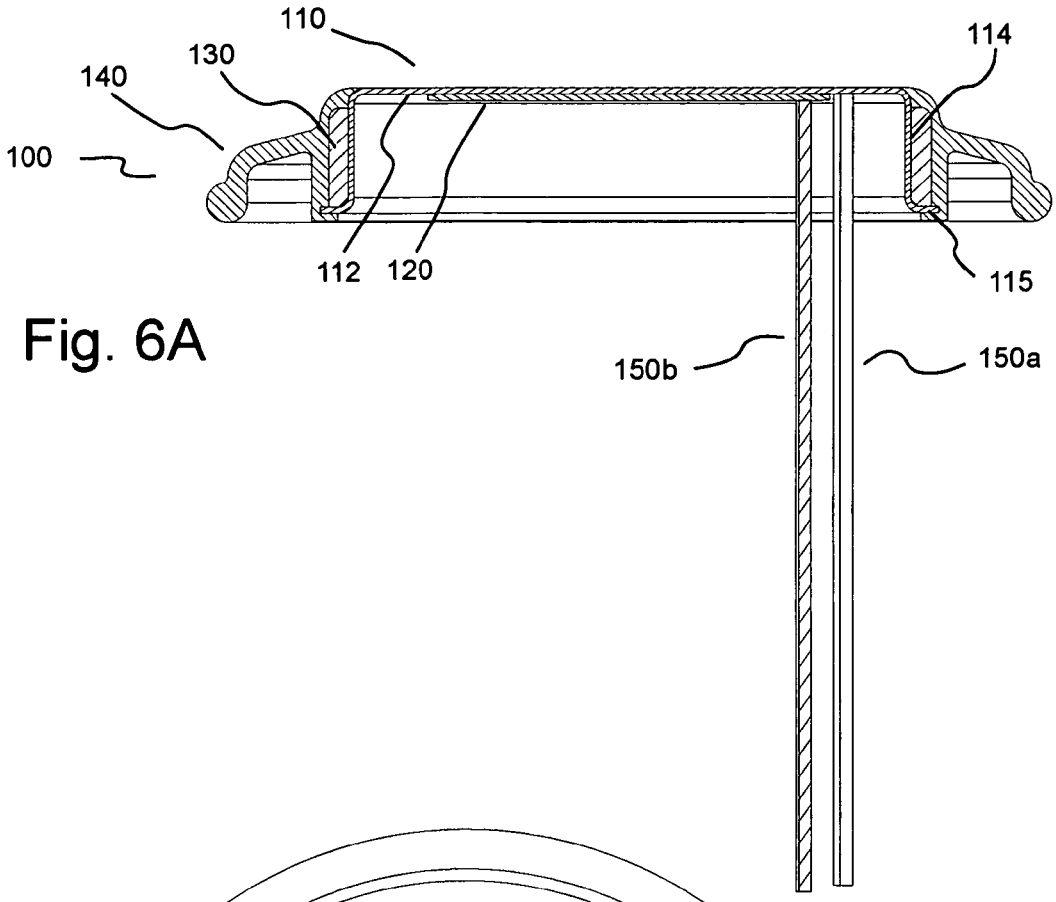
FIG. 6A illustrates a side cross-sectional view of the system of FIG. 5A with the piezoelectric transducer attached to the substrate and electrical connections attached to the system.
Figure 6B:
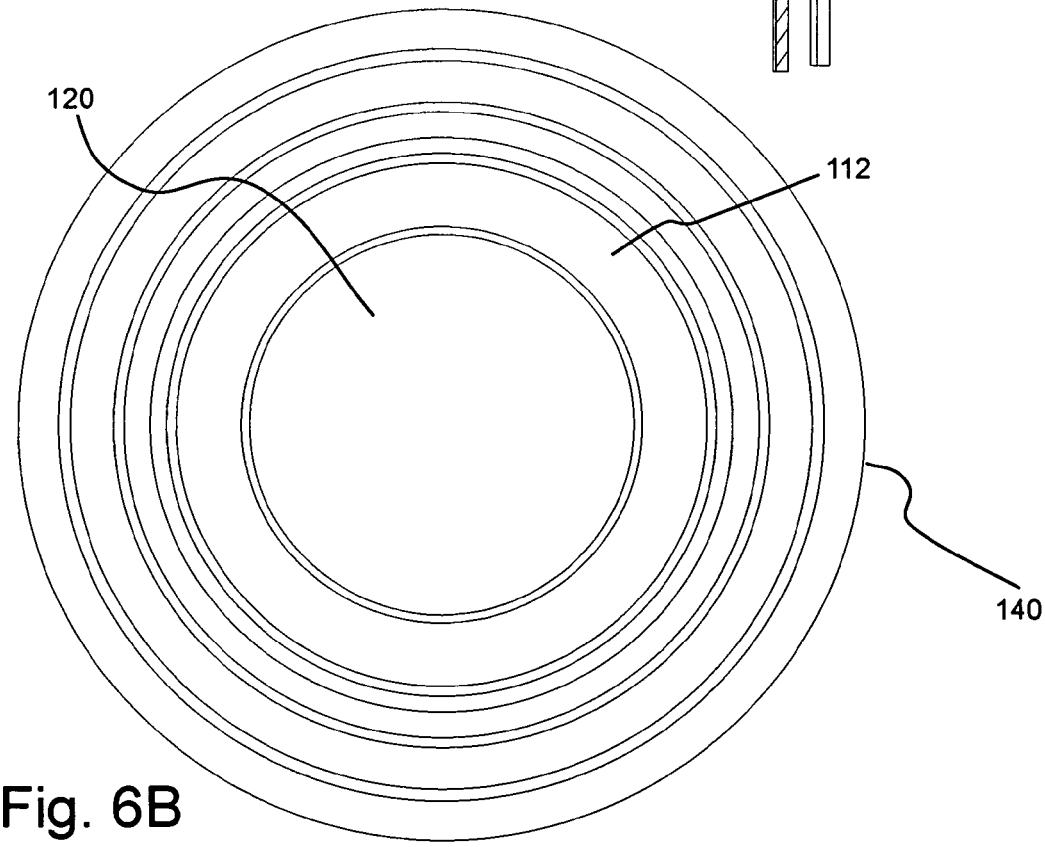
FIG. 6B is a bottom view of the system of FIG. 6A.

FIGS. 6A and 6B, illustrate a cross-sectional view and a bottom view, respectively, of system 100 after transducer 120 is attached thereto. Attachment of transducer 120 to system 100 after the overmolding of support member 140 can, for example, eliminate the possibility of damage to transducer 120 during the overmolding process. FIG. 6A also illustrates electrical connections comprising two lead wires 150*a* and 150*b* in electrical connection with transducer 120.

Figure 7A:
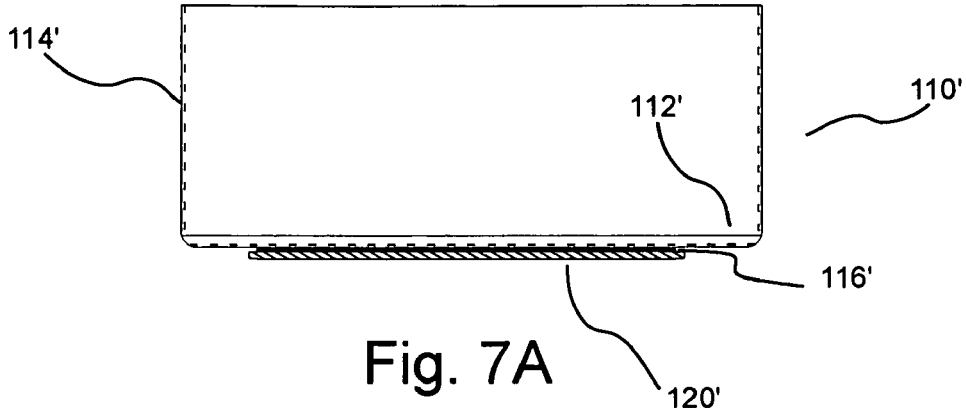
FIG. 7A illustrates a side cross sectional view of another embodiment of a vibrating system of the present invention including a piezoelectric transducer wherein the sidewalls of the substrate are extended as compared to the vibrating system of FIG. 2A.
Figure 7B:
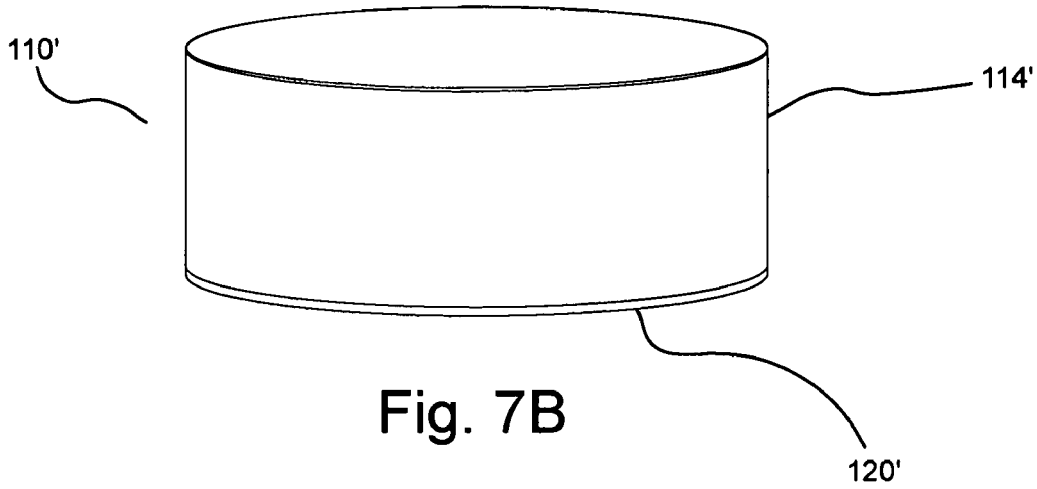
FIG. 7B illustrates a perspective view of the vibrating system of FIG. 7A.
Figure 7C:
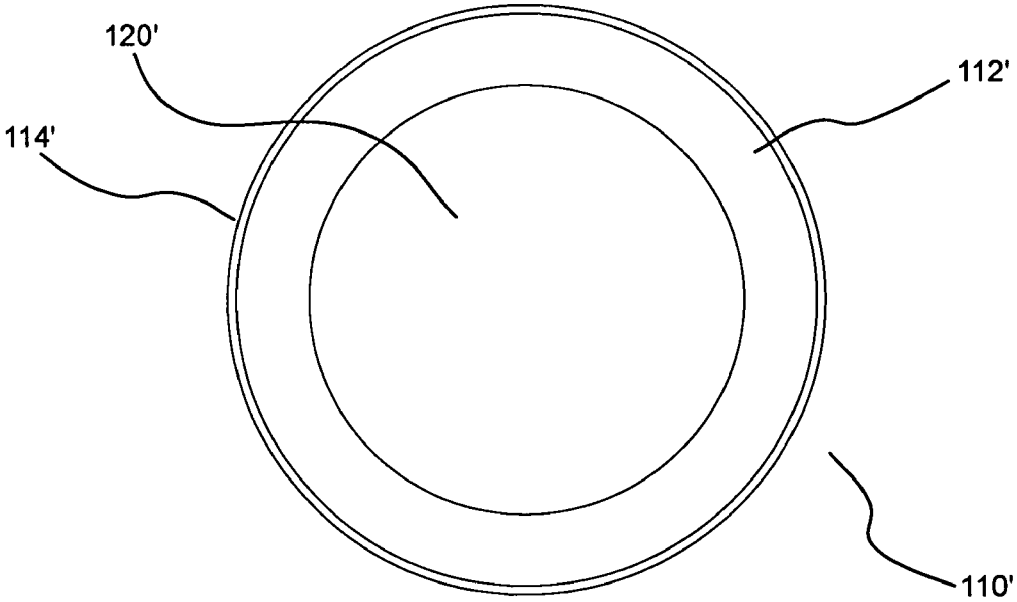
FIG. 7C illustrates a bottom view of the vibrating system of FIG. 7A.

FIGS. 7A-7C illustrate another embodiment of a system 100' of the present invention demonstrating how substrates of the present invention can operate as amplifiers. In FIGS. 7A through 7C, those elements of system 100' that are the same or similar in construction and/or function to corresponding elements of system 100 are numbered in a corresponding manner with the addition of the designation "'" thereto. Similar to system 100, substrate 110' of system 100' is formed in the general shape of a cup, including a generally planar surface 112' to which a transducer 120' is attached and a generally cylindrical sidewall 114'. In the embodiment of system 100', however, sidewall 114' of substrate 110' is extended in length as compared to sidewall 114 of system 100. By appropriately dimensioning sidewalls 114' of substrate 110', substrate 114' can operate as a horn or amplifier of sound created by vibrating sound element 124'.

As described above for system 100, vibrating sound element 124' includes a transducer 120' that is attached to generally planar surface 112' via a bond 116' (see FIG. 7A), such as a metal adhesion bond as described above, that provide for an attachment of transducer 120' to surface 112' that does not vary significantly in mechanical properties over a wide temperature range. In the embodiment of FIGS. 7A through 7C, transducer 120' is attached to surface 112' on the side thereof opposite from the direction in which sidewall 114' extends.

In several embodiments of the present invention, a system 100 as illustrated, for example, in FIG. 2A was used in connection with an acoustic amplifier in the form of a transverse acoustic amplifier, similar to a quarter-wave resonator. Typically, the acoustic frequency of an amplifier is matched to the resonant frequency of the sound generating element used therewith. However, to optimize output over a broad temperature range in the present invention, the acoustic resonance frequency of the amplifier was set to be lower than the mechanical resonance frequency of the transducer for a first, lower temperature (for example, 70° F.), while the acoustic resonance frequency of the amplifier was set to be higher than the mechanical resonance frequency of the transducer for a second, higher temperature (for example, 500° F.).

Figure 8:
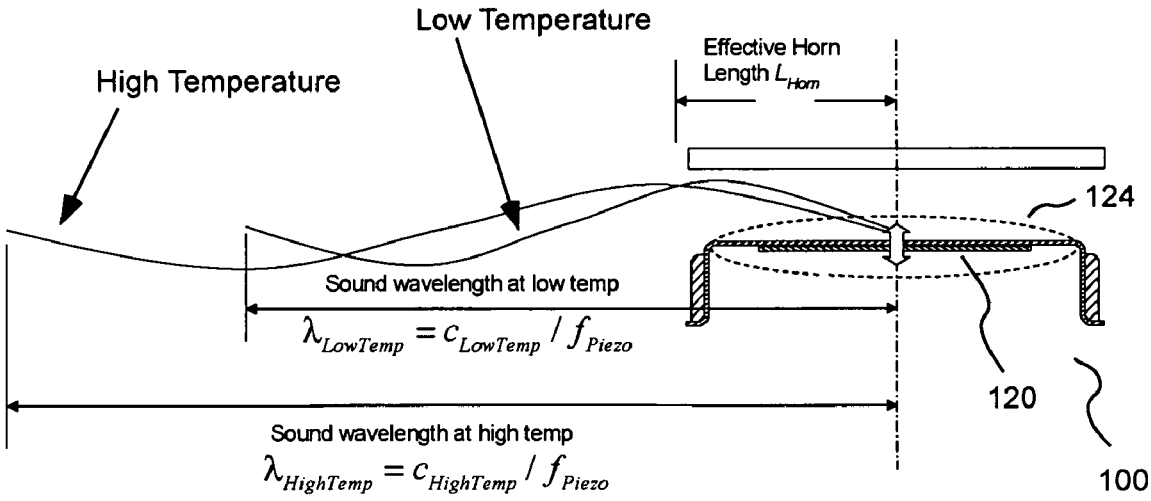
FIG. 8 illustrates operation of an embodiment of an amplifier of the present invention in the form of a transverse acoustic amplifier, similar to a quarter wave resonator.
Figures 9A, 9B:
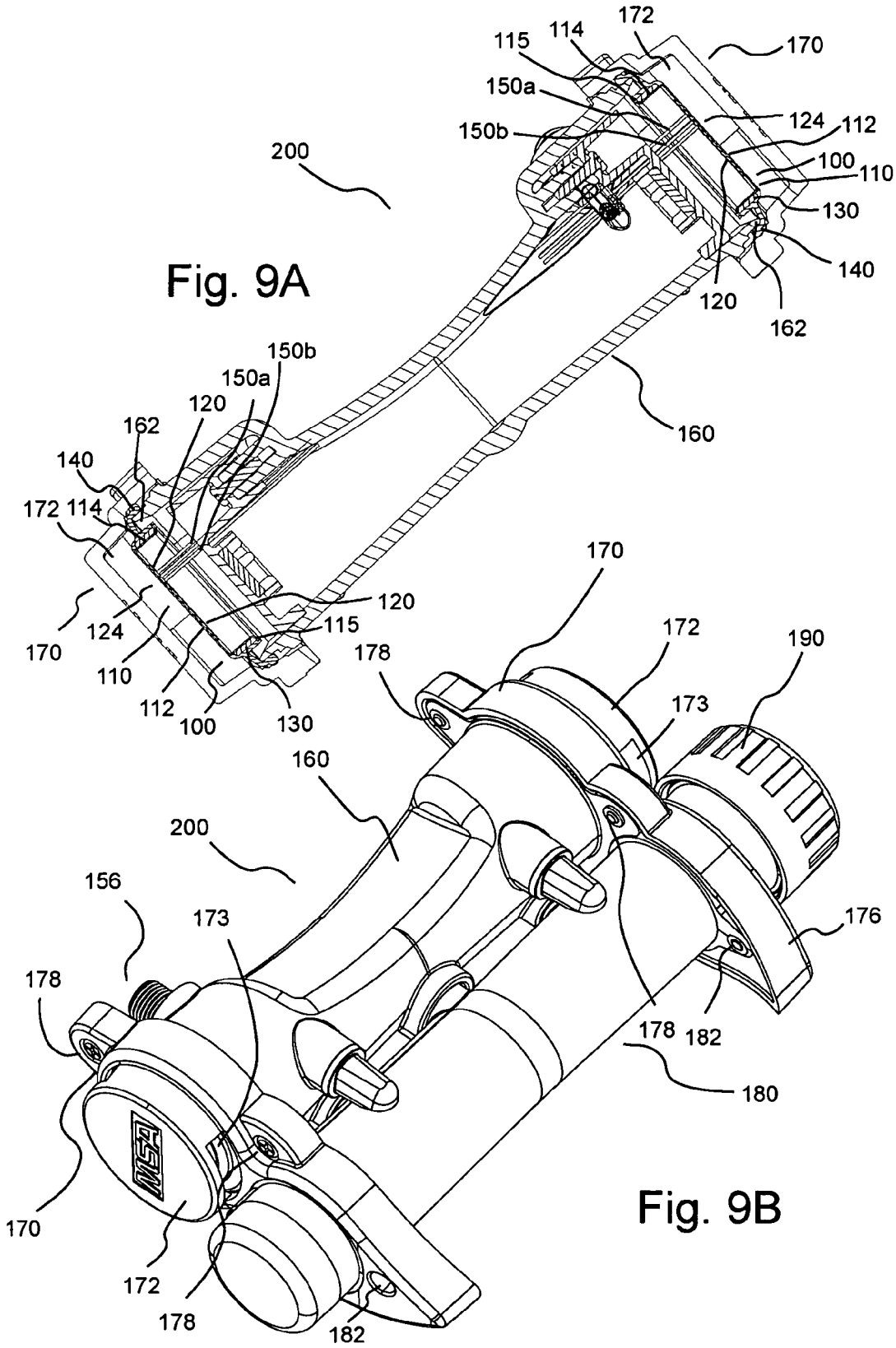
FIG. 9A illustrates a side cross-sectional view of a Personal Alert Safety System or PASS alarm of the present invention including two of the sound generating systems of FIG. 6B.
FIG. 9B illustrates a perspective view of the PASS alarm and a connected battery module.
Figure 9C:
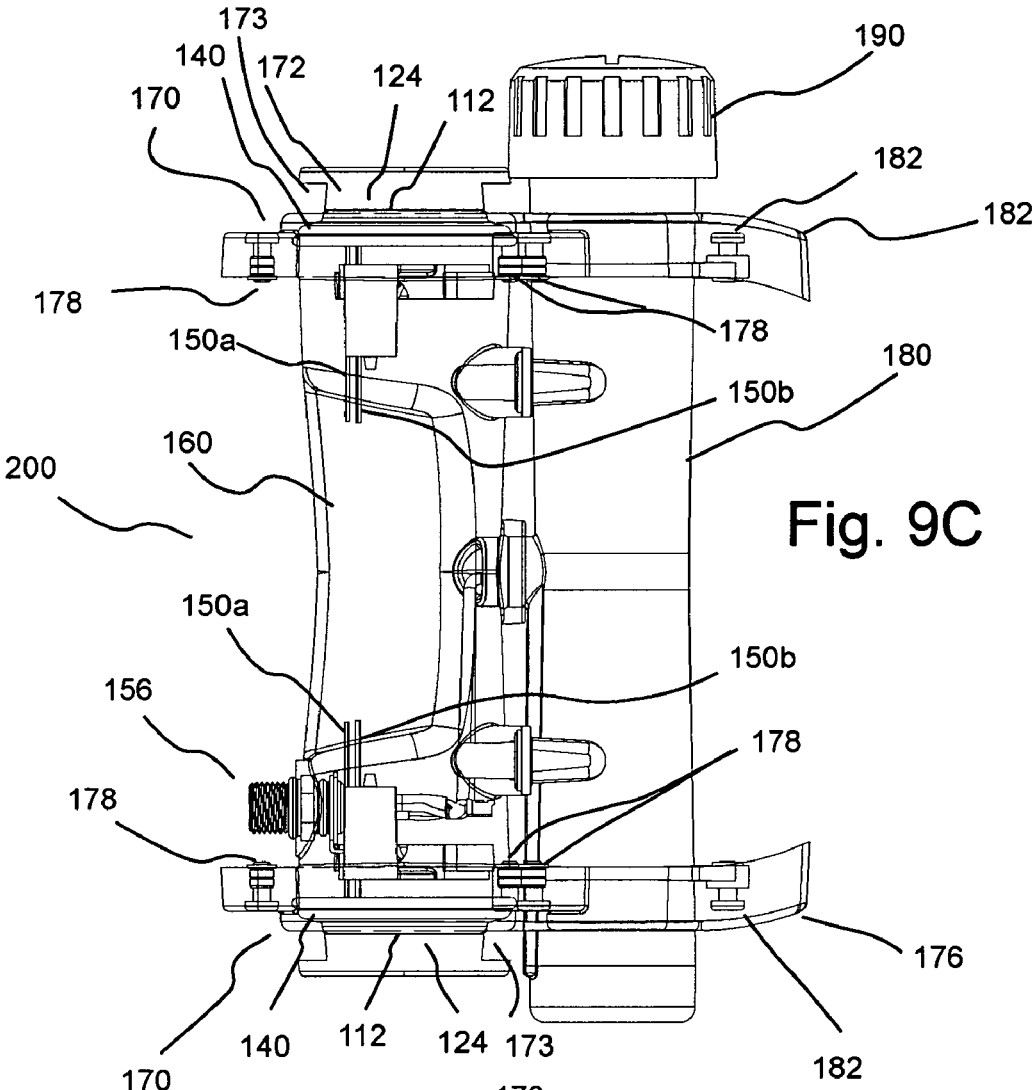
FIG. 9C illustrates a side view of the PASS alarm and the connected battery module.
Figure 9D:
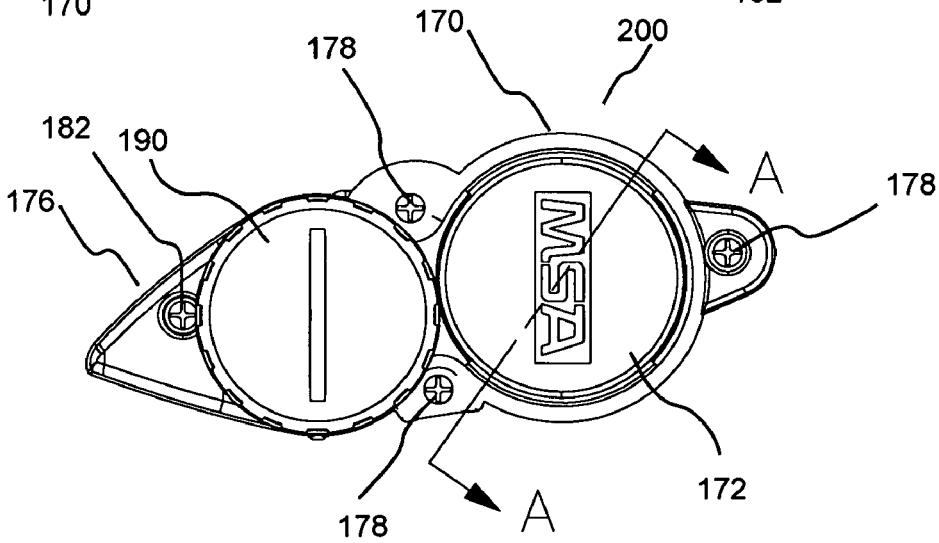
FIG. 9D illustrates an end view of the PASS alarm and the connected battery module.
Figure 9E:
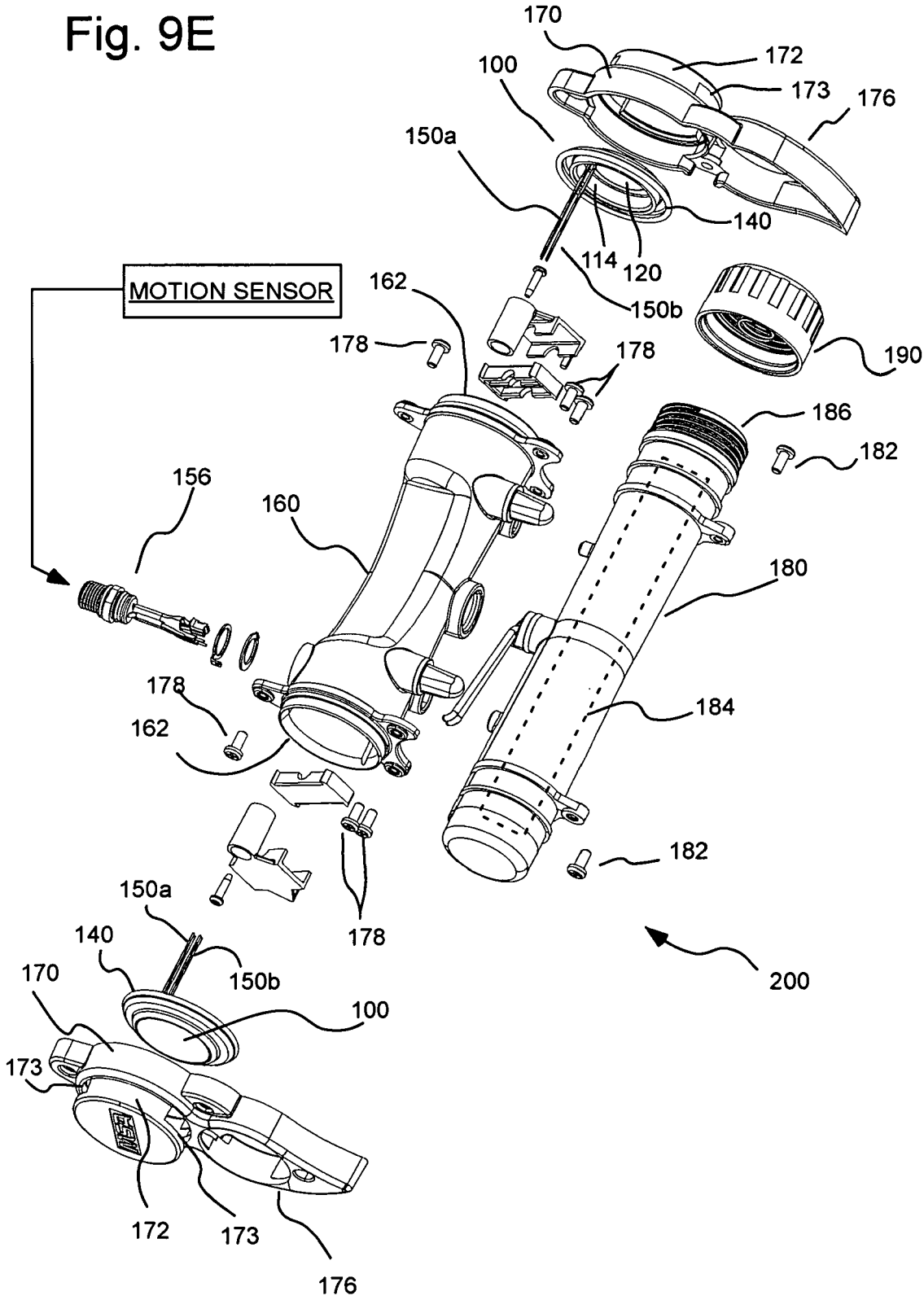
FIG. 9E illustrates a perspective exploded view of the PASS alarm and the battery module.
Figure 9G:
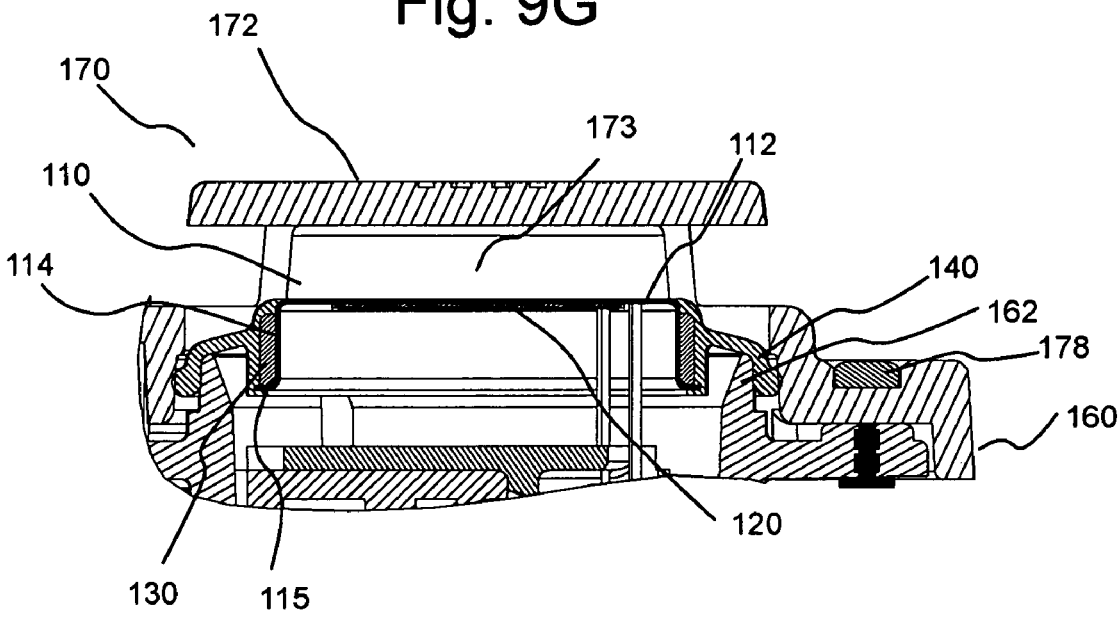
FIG. 9G illustrates a side cross-sectional view of the cap and acoustic amplifier of FIG. 9F along section B-B.
Figure 9F:
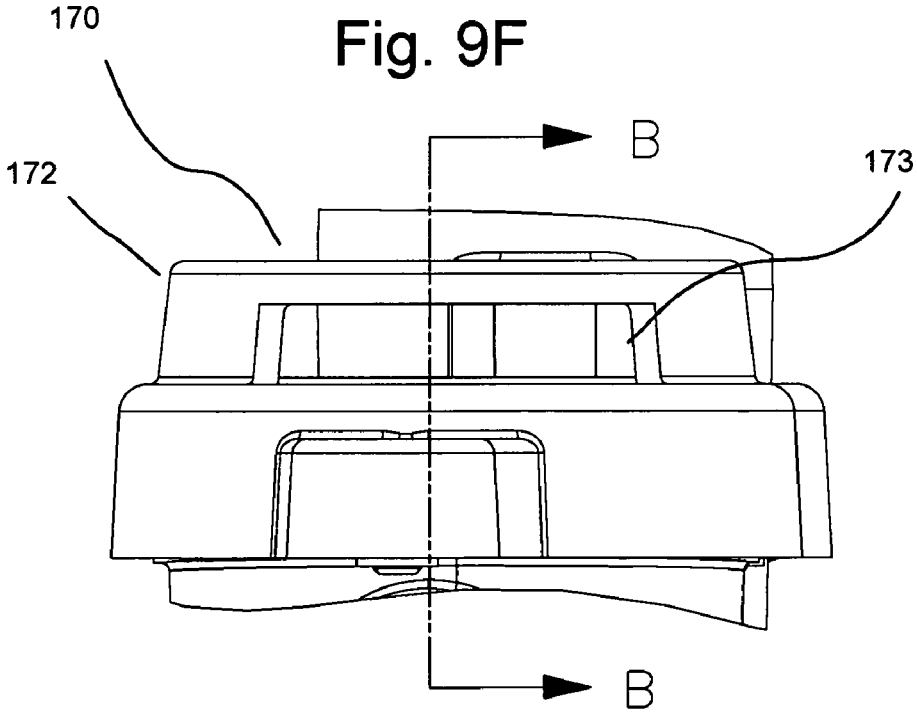
FIG. 9F illustrates an enlarged side view of the cap of the PASS alarm, which forms an amplifier in the form of a transverse acoustic amplifier, similar to a quarter wave resonator.

In that regard, the speed of sound in air (c) increases with increasing temperature as a result of changes in the properties of the air (for example, density and stiffness). The change in the speed of sound with increasing temperature increases the acoustic resonance frequency of quarter-wave resonators or horns. To achieve a similar acoustic amplification for air temperatures of, for example, 70° F. and 500° F., a horn length $L_{Horn}$ (see, for example, FIG. 8) was chosen such that the acoustic resonance of the horn for an air temperature of 70° F. was lower than the mechanical resonance of sound element 124 including transducer 120, but that the acoustic resonance of the horn for an air temperature of 500° F. was higher than mechanical resonance of sound element 124. The relationship between acoustic resonance frequency f, the speed of sound and the effective horn length are set forth below.

$$f_{HornLowTemp} = \frac{c_{LowTemp}}{4L_{Horn}}$$

$$f_{HornHighTemp} = \frac{c_{HighTemp}}{4L_{Horn}}$$

Once again, the horn length was determined using the following relationship:

$$f_{HornLowTemp} < f_{Piezo} < f_{HornHighTemp}.$$

FIGS. 9A through 9G illustrate an embodiment of an audible alarm system 200 for use in, for example, a PASS alarm including two systems 100 as described above. PASS is an acronym for Personal Alert Safety System. Such systems are, for example, worn by firefighters and produce a loud, highly discernible audio alarm in the case of a distress condition. For example, the PASS alarm can include a motion sensor to sense an absence of motion if the wearer becomes immobilized for period of time (for example, 25 seconds). The audible alarm of the PASS alarm notifies others that help is needed and assists rescue crews in locating the distressed firefighter.

Pass alarm 200 can, for example, include housing 160 with a system 100 operatively connected at a first end of housing 160 and another system 100 operatively connected at a second, opposite end of housing 160. Flexible support member 140 of each system 100 is, for example, suitably formed to contact and form a seal with a perimeter 162 of an opening at each end of housing 160 (see, for example, FIG. 9A). As described above, flexible support members 140 mechanically isolate vibrating sound elements 124 from housing 160 without adversely affecting the vibration thereof.

Support member 140 of each system 100 is securely held in place against perimeters 162 of housing 160 at each end thereof via a cap 170. Each cap 170 forms an acoustic amplifier 172 (which operates similarly to a quarter-wave resonator as described above) including sound ports or openings 173. The acoustic amplifiers 172 are positioned longitudinally outside of each vibrating sound element 124. By placing a system 100 at each end of PASS alarm 200 and positioning PASS alarm 200 generally centrally below the air tank of a firefighter's self contained breathing apparatus (SCBA), in situations where the acoustic output from one of systems 100 is audibly muted as a result of the position of the wearer the other system 100 will be unmuted and audible. In that regard, the air tank of the SCBA will typically cause an immobilized wearer to roll to one side when the wearer is on his or her back so that at least one end of PASS alarm 200 is unobstructed.

As typical with PASS alarms, PASS alarm 200 is powered by one or more batteries. In the illustrated embodiment, caps 170 include a battery module retainer 176 formed to retain a generally cylindrical battery module 180 as, for example, illustrated in FIG. 9B. Caps 170 can, for example, be maintained in connection with housing 160 via screws 178, and battery module 180 can be maintained in connection with battery module retainers 176 via screws 182. Batteries 184 (illustrated schematically in dashed lines in FIG. 9E) can be placed within battery module 180 via an opening 186 on one end thereof and then enclosed therein by an end cap 190.

Upon an output signal from a motion sensor (see FIG. 9E), which is in communicative connection with PASS alarm 200 via a connector 156, that the wearer has been motionless for a predetermined period of time, energy from batteries 184 is supplied to transducers 120 via leads 150*a* and 150*b* so that vibrating sound elements 124 begin to vibrate, producing an audible alarm. The motion sensor can, for example, be a solid-state accelerometer device as known in the art.

PASS alarm 200 (and individual systems 100 thereof) meet or exceed the proposed NFPA 1982: 2007 edition standard (a copy of which was filed with the provisional application). The NFPA 1982: 2007 edition standard includes, for example, water immersion requirements and testing wherein a PASS is exposed to 350° F. for 15 minutes and then to water submersion in 1.5 m (4.9 ft) also for 15 minutes for each of six cycles. The PASS is examined to determine that there has been no water ingress. All PASS signals must function properly, and electronic data logging functions operate properly. The PASS is then re-immersed in the test water for an additional 5 minutes with the power source compartment(s) open. Following that 5-minute immersion, the PASS is removed from the water and wiped dry. The electronics compartment is then opened and examined to determine if there has been water ingress. High temperature resistance requirements have been revised and new high temperature functionality requirements and testing procedures have been added. For example, the PASS is exposed to 500° F. for 5 minutes while mounted in a circulating hot air oven. Upon removal from the oven, the PASS alarm signal must function at or above the required 95 dBA sound level for the required duration of the signal. Electronic data logging functions must operate properly, and no part of the PASS can show evidence of melting, dripping, or igniting. New tumble-vibration requirements and testing have also been added. For example, the PASS is required to be "tumbled" in a rotating drum for 3 hours. Subsequently, the PASS alarm signal must function at the required 95 dBA sound level, and electronic data logging functions must operate properly. Further new requirements are intended to prevent muffling of the alarm signal. In several tests, the PASS is mounted on a test subject and evaluated in five positions (face down with arms extended, supine left, supine right, fetal right with knees drawn to chest, fetal left with knees drawn to chest). The alarm signal must function at or above the required 95 dBA sound level in each of the positions.

The foregoing description and accompanying drawings set forth the preferred embodiments of the invention at the present time. Various modifications, additions and alternative designs will, of course, become apparent to those skilled in the art in light of the foregoing teachings without departing from the scope of the invention. The scope of the invention is indicated by the following claims rather than by the foregoing description. All changes and variations that fall within the meaning and range of equivalency of the claims are to be embraced within their scope.

What is claimed is:

1. A device comprising a substrate and a transducer attached to the substrate, the substrate comprising a surface to which the transducer is attached, the substrate further comprising at least one edge member extending along at least a portion of an outside edge of the surface, the at least one edge member being stiffer than the surface and forming a reaction mass for the surface, wherein mass associated with the at least one edge member results in a ratio of mass associated with the edge member to mass of the surface of at least 1.5 to 1.

2. The device of claim 1 wherein the transducer is adapted to vibrate.

3. The device of claim 2 wherein the transducer is selected from the group consisting of a piezoelectric transducer, an electrostrictive transducer and a magnetostrictive transducer.

4. The device of claim 2 wherein the surface is generally planar.

5. The device of claim 2 wherein the at least one edge member extends in at least one direction outside of the plane of the surface.

6. The device of claim 5 wherein the at least one edge member is comprises a sidewall.

7. The device of claim 6 wherein the sidewall extends around the full length of the outside edge of the surface.

8. The device of claim 5 wherein the surface and the at least one edge member of the substrate are formed from a monolithic piece of material.

9. The device of claim 8 wherein the material is a metal.

10. The device of claim 5 wherein mass associated with the at least one edge member results in a ratio of mass associated with the at least one edge member to mass of the surface of at least 3 to 1.

11. The device of claim 10 wherein the at least one edge member further comprising a mass element adjacent to the sidewall to enhance vibration of the surface.

12. The device of claim 5 wherein the transducer is attached to the surface of the substrate such that the resonance frequency of the surface and attached transducer changes less than 25% from 70° F. to 250° F.

13. The device of claim 5 wherein the transducer is attached to the surface of the substrate such that the device, when excited at the resonance frequency of the surface and attached transducer, after removal from an oven wherein the surface and attached transducer were heated to approximately 500° F. for at least five minutes, provides a sound level that does not diverge from the room temperature sound level by more than 10 dBA or provides an output of at least 95 dBA at a distance of 3 meters in an anechoic chamber, wherein sound level is measured in peak sound pressure level.

14. The device of claim 13 wherein the transducer is attached to the surface of the substrate by a metallic bonding agent between the transducer and the surface.

15. The device of claim 14 further comprising a flexible suspension in operative connection with the at least one edge member and extending outward from the at least one edge member, the suspension be adapted to support the substrate.

16. The device of claim 15 wherein the flexible suspension comprises an elastomeric material.

17. The device of claim 16 wherein the flexible suspension is adapted to form a seal with a housing with which the device is placed in operative connection.

18. The device of claim 2 further comprising an acoustic amplifier, the acoustic resonance frequency of the acoustic amplifier being lower than the mechanical resonance frequency of the transducer at a temperature of 70° F.

19. The device of claim 2 wherein the acoustic resonance frequency of the acoustic amplifier is higher than the mechanical resonance frequency of the transducer at a temperature of 500° F.

20. A device comprising a substrate and a transducer attached to the substrate, the substrate comprising a surface to which the transducer is attached and at least one edge member extending along at least a portion of an outside edge of the surface, the at least one edge member being stiffer than the surface, the device further comprising a flexible suspension in operative connection with the at least one edge member and extending outward from the edge member the suspension be adapted to support the substrate.

21. The device of claim 20 wherein the flexible suspension comprises an elastomeric material.

22. The device of claim 21 wherein the flexible suspension is adapted to form a seal with a housing with which the device is placed in operative connection.

23. The device of claim 21 further comprising an acoustic amplifier, the acoustic resonance frequency of the acoustic amplifier being lower than the mechanical resonance frequency of the transducer at a temperature of 70° F.

24. The device of claim 23 wherein the acoustic resonance frequency of the acoustic amplifier is higher than the mechanical resonance frequency of the transducer at a temperature of 500° F.

25. The device of claim 20 wherein the transducer is attached to a surface of the substrate by a metallic bonding agent between the transducer and the surface such that the device, when excited at the resonance frequency of the surface mad attached transducer, after removal from an oven wherein the surface and attached transducer were heated to approximately 500° F. for at least five minutes, provides a sound level that does not diverge from the room temperature sound level by more than 10 dBA or provides an output of at least 95 dBA at a distance of 3 meters in an anechoic chamber, wherein sound level is measured in peak sound pressure level.

* * * * *

UNITED STATES PATENT AND TRADEMARK OFFICE

CERTIFICATE OF CORRECTION

PATENT NO. : 8,229,142 B2
APPLICATION NO. : 12/006494
DATED : July 24, 2012
INVENTOR(S) : Vincent M. Colaizzi et al.

It is certified that error appears in the above-identified patent and that said Letters Patent is hereby corrected as shown below:

Column 13, claim 6, line 17, delete “is”.
Column 14, claim 19, line 12, “2” should be changed to --18--.
Column 14, claim 25, line 42, “mad” should be changed to --and--.

Signed and Sealed this
Sixteenth Day of October, 2012

David J. Kappos

David J. Kappos
*Director of the United States Patent and Trademark Office*